United States Patent [19]

Thomas

[11] Patent Number: 4,989,355

[45] Date of Patent: Feb. 5, 1991

[54] DISPLAY CARD

[76] Inventor: Robb Thomas, 655 W. Irving Park, Chicago, Ill. 60613

[21] Appl. No.: 354,927

[22] Filed: May 22, 1989

[51] Int. Cl.[5] ..... B44F 1/00

[52] U.S. Cl. ..... 40/427; 40/124.1; 350/617

[58] Field of Search ..... 40/427, 124.1, 900; 272/8 M, 8 R; 434/303; 350/602, 617, 618, 622, 626, 632, 4.1; 446/219, 147, 243; 206/44 R

[56] References Cited

U.S. PATENT DOCUMENTS

| | | | |
|---|---|---|---|
| 169,882 | 11/1875 | Adams | 446/219 X |
| 980,934 | 1/1911 | Faber | 350/632 |
| 1,346,017 | 7/1920 | Goodman | 446/219 X |
| 4,259,808 | 4/1981 | Oakes | 446/219 X |

FOREIGN PATENT DOCUMENTS

| | | | |
|---|---|---|---|
| 1204402 | 9/1970 | United Kingdom | 446/243 |

*Primary Examiner*—James R. Brittain
*Assistant Examiner*—Joanne Bonifanti
*Attorney, Agent, or Firm*—Foley & Lardner

[57] ABSTRACT

A display card including a pair of panels hingedly interconnected at their edges, one of the panels including a relective surface, an indicia secured to the surface of the other panel, the indicia being in a face-to-face relationship with the reflective surface when the panels are in a closed position, and gusset means holding said panels in an angular relationship wherein the virtual image of the indicia will appear in the reflective surface of the one panel.

7 Claims, 4 Drawing Sheets

DISPLAY CARD

BACKGROUND OF THE INVENTION

1. Field of the Invention

This invention relates to display-type literature such as cards, brochures, advertisements, books, etc., and particularly to the display of single or multiple reflective images in three-dimensional form.

2. Description of the Prior Art

Display-type literature is generally presented in two-dimensional patterns on the inside surfaces of hingedly connected panels. When the panels are open, the pattern appears the same whether the panels are laid out flat or opened at an angle less than 180°. There has been some effort to create three-dimensional forms by providing foldout-type patterns which are connected to the panels. The three-dimensional form may be of a figure, plant or any other such configuration.

Summary of the Invention

The present invention provides display-type literature shown in the form of a card which utilizes a reflective image on one or both panels of the card that is reflected off a mirror-like surface on the opposite panel, thus creating a three-dimensional form. The reflection of the pattern from the mirror-like surface creates the impression that the pattern comes from behind the mirror i.e., from the virtual image of the pattern. If both panels are provided with a mirrored surface, the angular relation of the panels can be set so that the reflection from one panel to the other creates multiple images of the pattern resulting in the creation of a three-dimensional image. One of the principal objects of the invention is the creation of three-dimensional images from two-dimensional patterns.

A principal advantage of the invention is the simplicity of the pattern required to produce an attractive and eye-catching image. Other objects and advantages will become apparent from the following detailed description, claims and drawings.

DETAILED DESCRIPTION OF THE DRAWINGS

Figure 1:
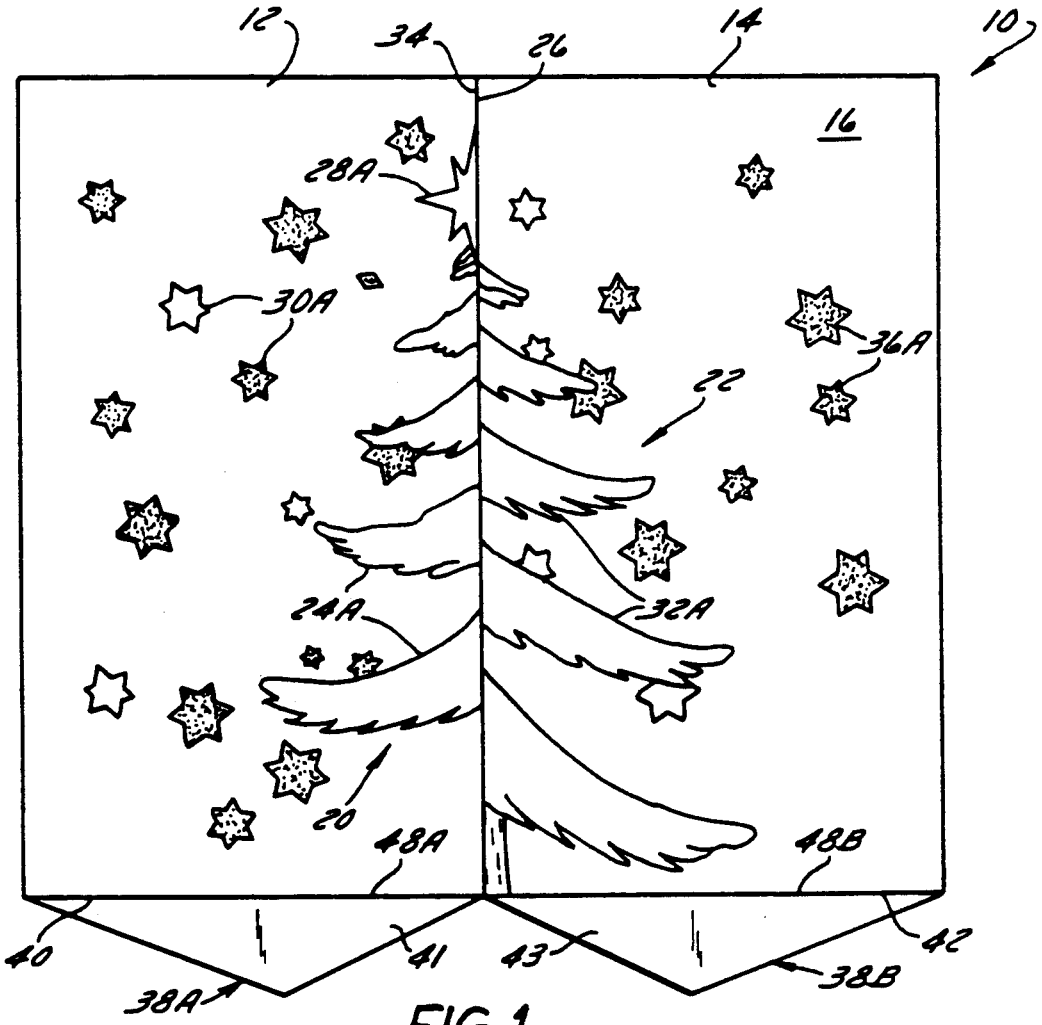
FIG. 1 is a plan view of a two-paneled display card having multiple images on reflective surfaces with the card layed out in a common plane.

Before describing one embodiment of the invention in detail, it is to be understood that the invention is not limited in its application to the details of construction or the arrangement of components set forth in the following description and illustrated in the drawings. The invention is capable of other embodiments and can be practiced or carried out in various ways. Also, it is to be understood that the phraseology and terminology employed herein is for the purpose of description and should not be regarded a limiting.

DESCRIPTION OF A PREFERRED EMBODIMENT

The display-type literature is described herein with respect to card 10 as shown in FIGS. 1–6 which includes two panels 12 and 14. The panels can be formed from a stiff material such as a plastic or composition material. Means are provided for hingedly connecting the panels 12 and 14 along one edge 26, 34, of each of the panels respectively, for folding the panels inwardly into face-to-face relation for mailing or storage. Such means can be in the form of a crease in the plastic material 16 to form a hinge between the panels 12 and 14, or in the form of an adhesive tape 18 which is applied to the back of the two panels 12 and 14.

Figure 4:
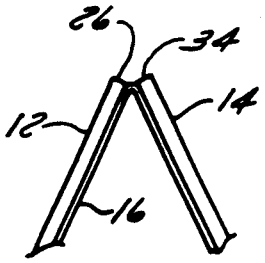
FIG. 4 is a top view of a portion of the panels showing the hinge connection.
Figure 5:
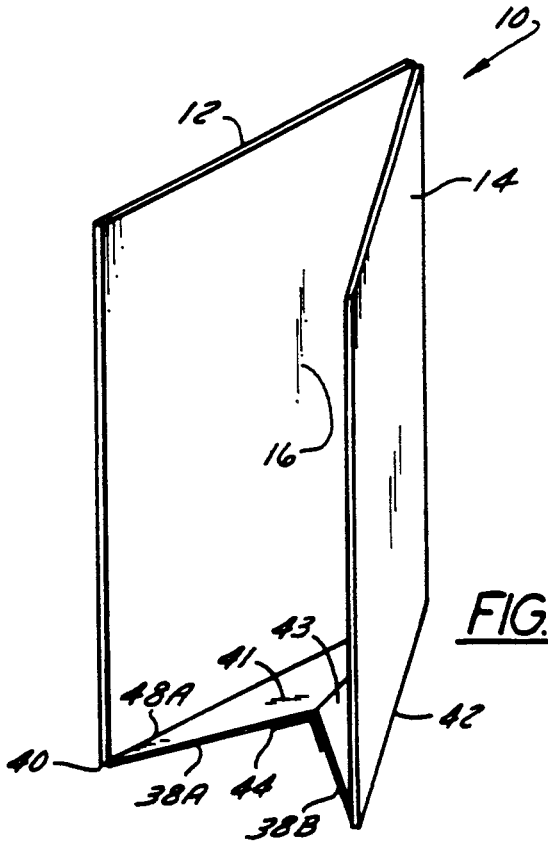
FIG. 5 is a view of the panels opened to the angle of the gusset.

In this regard, the plastic material 16 used in the embodiment of FIGS. 1 through 6 is in the form of a sheet of plastic material having a metallized polyester surface which provides a reflective finish on one side and is provided with an adhesive on the other side for securing the sheet 16 to the panels 12 and 14. The material 16 is secured to the inside surfaces of the panels 12, 14 as seen in FIG. 4 to allow the panels to fold along the edges 26, 34 into face-to-face relation. In this embodiment of the invention, the reflective metallized material is provided on both of the panels 12 and 14.

Figure 6:
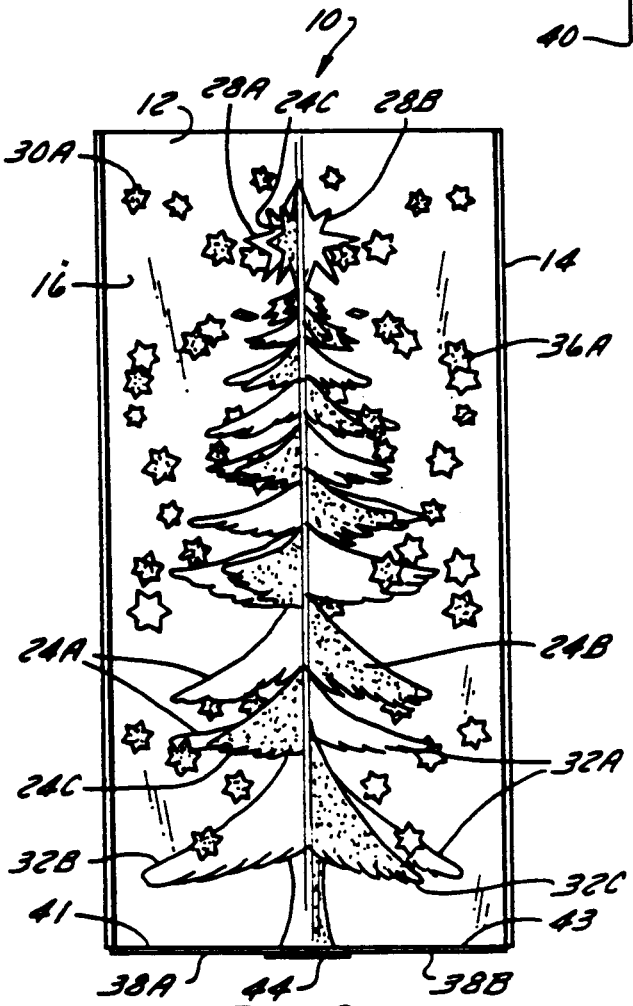
FIG. 6 is a front view of the display card opened to the limits of the gusset joined by a three-dimensional figure.

In order to obtain a three-dimensional appearing image, a pattern 20 is provided on the reflective metallized surface on panel 12 and a pattern 22 is provided on the reflective metallized surface of panel 14. The patterns 20 and 22, as described herein are arranged to provided an image of a Christmas tree as seen in FIG. 6. In this regard and referring to FIG. 1, it will be noted that the pattern 20 includes branches 24A which are provided along the inside edge 26 of the panel 12. A half of a star 28A is provided at the top of the branches 24A. Stars 30A are randomly located on the face of the panel 12. The panel 14 is provided with branches 32A along the edge 34 of the panel 14. Stars 36A are randomly scattered throughout the remainder of the panel 14.

Figure 2:
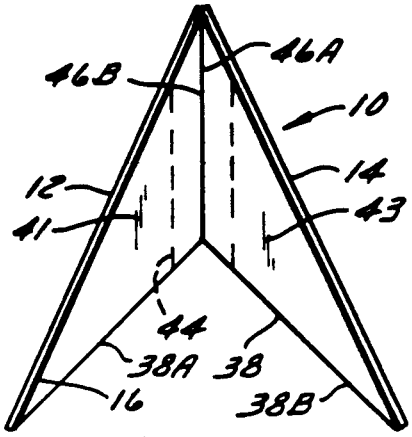
FIG. 2 is a top plan view of the open gusset showing the angular relationship of the gusset panels.
Figure 3:
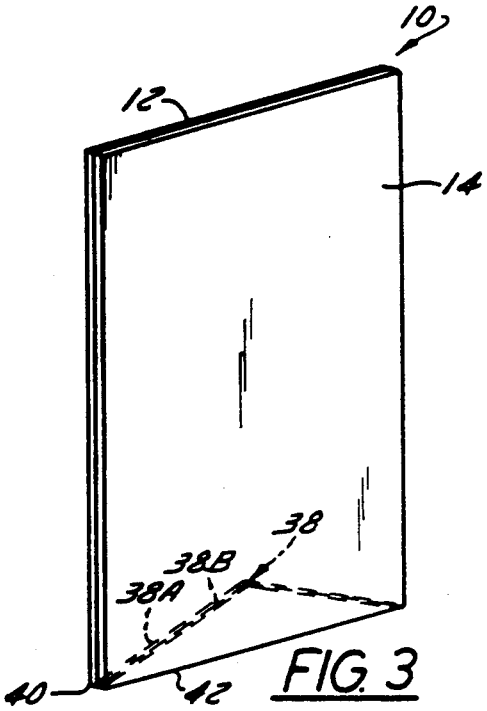
FIG. 3 is a perspective view of the card folded for packaging.

In order to obtain a three-dimensional image, the panels 12 and 14 are opened to a specific angular relationship. This is accomplished by means of a gusset 38 provided on the bottom edges 40 and 42 of the panels 12 and 14, respectively. As seen in FIG. 2 the gusset 38 is in the form of two triangular members 38A and 38B which can be hingedly interconnected by an adhesive strip of tape 44 that is adhered to the back of members 38A and 38B along the edges 46A and 46B. The gussets can be formed on the panels 12 and 14 by creasing the edges 48A and 48B to the edges 40 and 42 of the panels 12 and 14. The gussets could also be connected by means of triangular extensions 41 and 43 of the laminated material 16 as seen in FIG. 1. The gussets could also be connected to the face of the gusset portion 38A and the extension 43 is secured to the face of the gusset portion 38B.

When the panels 12 and 14 are folded in a face-to-face relationship, the gusset will fold inwardly to a position between the panels 12 and 14. When the panels are opened, the gusset 38 will limit the angular relationship of the panels to an angular relation of approximately 40°. Referring to FIG. 6, which is a view looking into the display card when opened to the 40° angle, it should be noticed that the branches 24A on panel 12 will appear as a virtual image 24B of branches 24A on panel 14 and a reflection of the virtual image 24B will appear on panel 12 as a virtual image 24C of virtual image 24B. The branches 32A will appear as branches 32B on branches 12 and the reflection of panel 32B will appear as branch 32C on panel 14. The half portion of star 28A on panel 12 appears as an image 28B of a portion of the star 28 on panel 14 and the reflection of the image 28B will appear as an image 28C of a portion of the star 28 on the panel 12. The stars 30A on panel 12 will appear as a virtual image 30B of star 30A on panel 14. The stars 36A on panel 14 will appear as a virtual image 36B of star 36A on panel 12. The multiple reflections of the virtual images produce a three-dimensional representation of the pattern.

Figure 7:
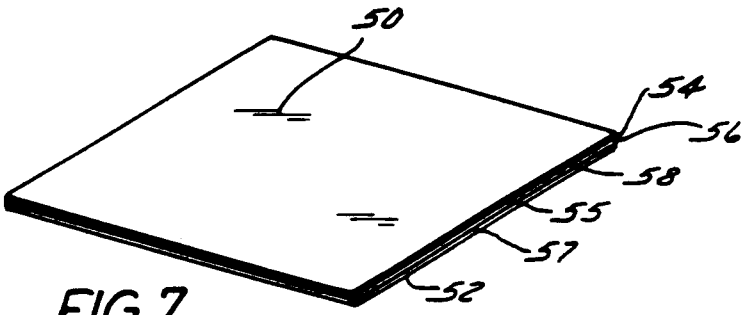
FIG. 7 is a view of an alternate form of display card.
Figure 8:
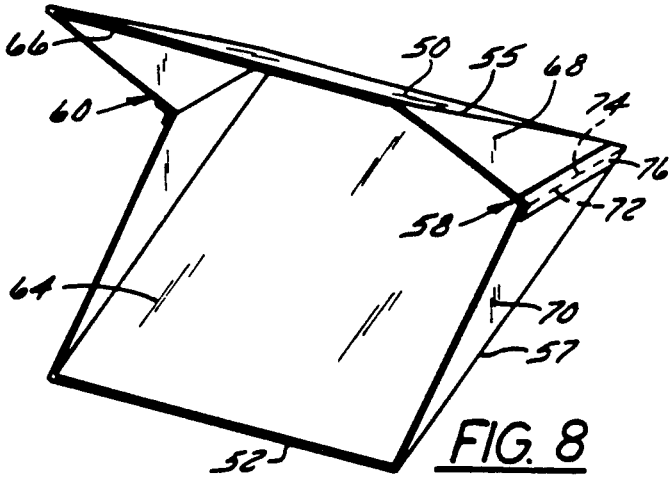
FIG. 8 is a view of the display card of FIG. 7 opened to the extent of the gusset.
Figure 9:
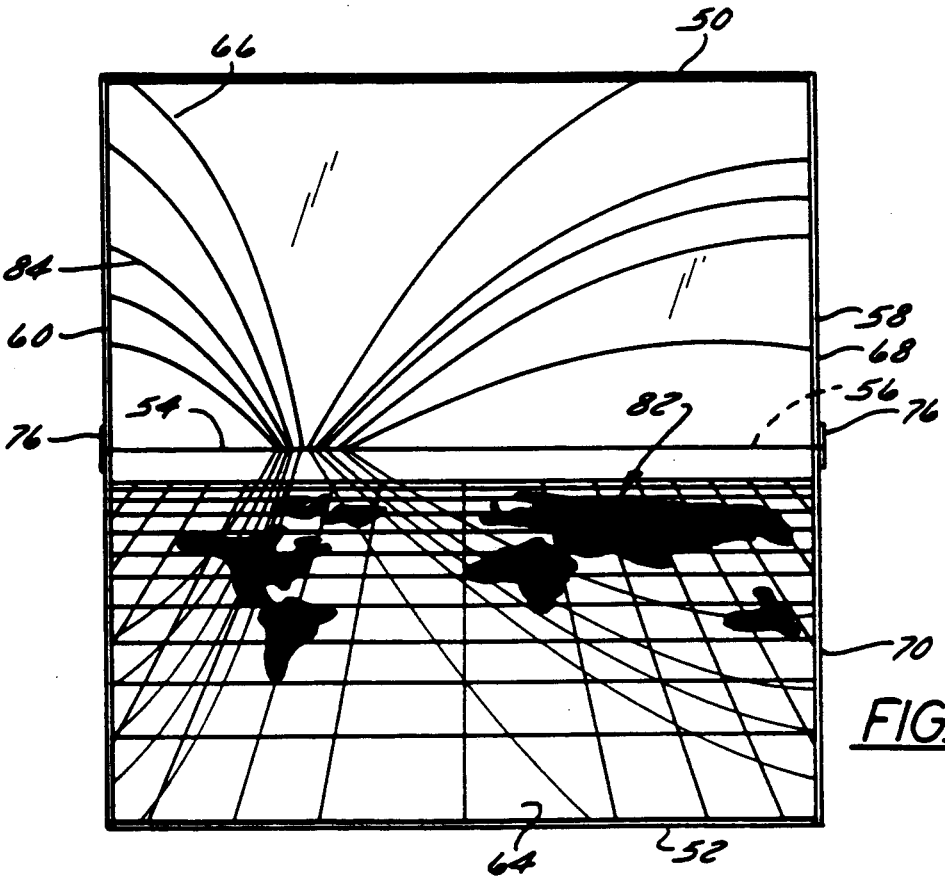
FIG. 9 is a front view of a card of FIG. 8 showing the three-dimensional pattern of the card.
Figure 10:
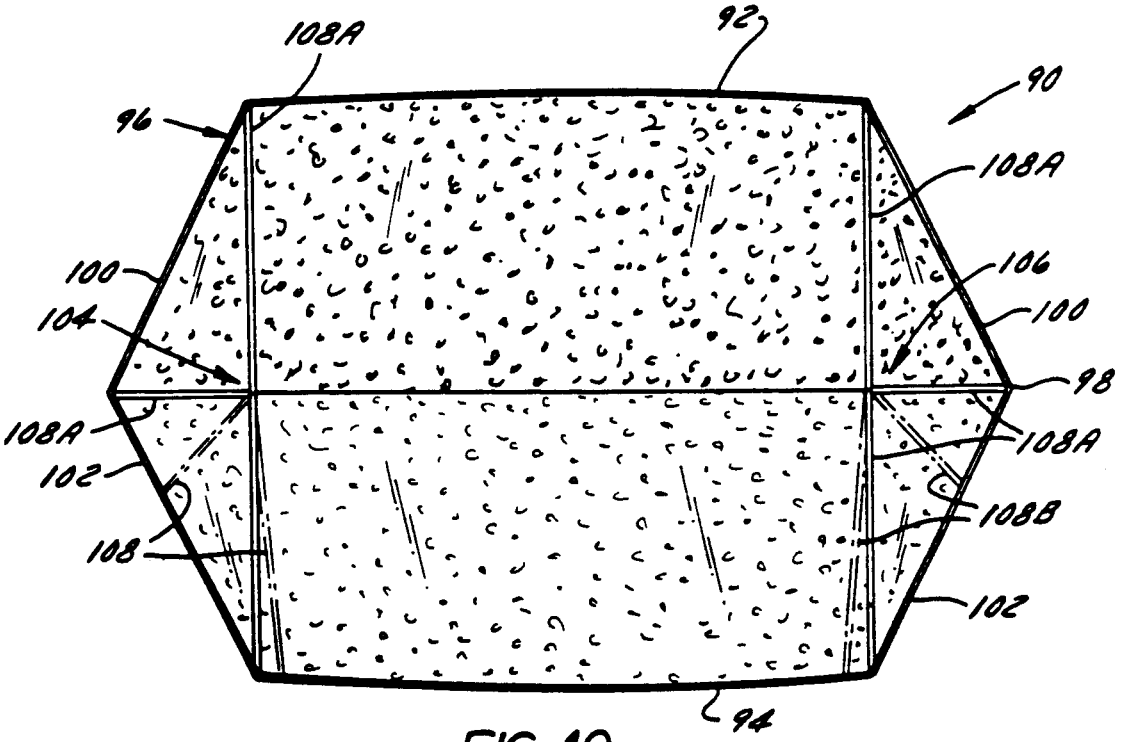
FIG. 10 is a perspective view of another alternate form of the invention.

The display-type card shown in FIGS. 7–9 includes panels 50 and 52 which are hingedly interconnected along their edges 54 and 56 respectively, by means of adhesive tape 51. A reflective metallized sheet 64 is laminated onto the inner face of panel 52. A plain paper sheet 66 is laminated to the inner surface of panel 50.

Gussets 58 and 60 are provided on each of the outer edges 55, 57 of the panels 50 and 52, respectively. The gussets are formed by triangular members 68 and 70. The members 68 and 70 are hingedly interconnected at the line of intersection of the edges 72 and 74, respectively, by means of adhesive tape 76. The edges 78 and 80 of members 68 and 70, respectively, are hingedly connected to the edges 55 and 56 by means of adhesive tape (not shown). The gussets 58 and 60 are arranged to collapse inwardly when the card is closed.

The paper sheet 66 is provided with a pattern 82 in the form of the continents of the world shown with a rainbow pattern 84 which rises from the back edge 54 of the panel 50. When the panels 50, 52 are opened to the extent of the gussets 68, 70, the virtual image of the rainbow pattern 84 will appear to be behind the pattern 82 of the world as shown in FIG. 9.

Figure 11:
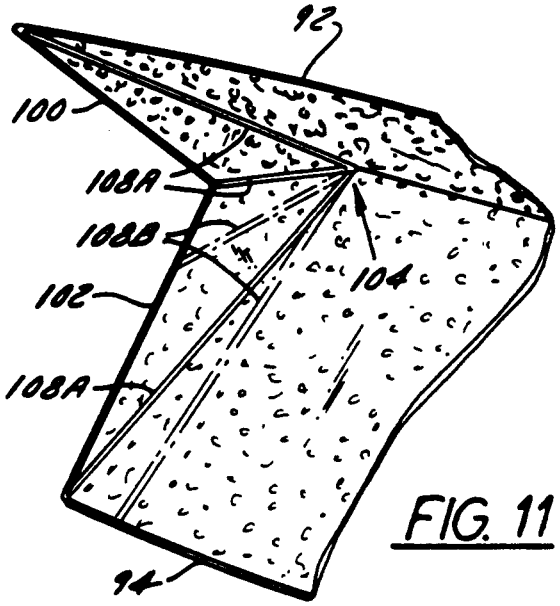
FIG. 11 is a view of the card of FIG. 10 showing the reflection of the seams of the gusset panels.

The embodiment of the invention shown in FIG. 11, is in the form of a display card 90 formed by panels 92 and 94 which are connected to gussets 96 and 98 that fold outwardly from the sides of the panels 92 and 94. The panels 92 and 94 are hingedly connected as described with reference to FIGS. 7 through 9. The upper panel 92 includes a plain paper pattern in the form of the stars in the heavens and the lower panel 94 includes the reflective metallized surface. The gussets 96 and 98 are formed of triangular gusset members 100 and 102. The members 100 having the same plain paper pattern as provided on panel 92 and the gusset member 102 having a reflective metallized surface forming a continuation of the reflective surface on panel 94. Multiple-type images are formed at the corners 104 and 106 of the card by providing colored lines 108A, in this case white lines, at the hinge connections of the gussets 96 and 98 with the panels 92 and 94 and at the hinge connections between the triangular members 100 and 102 which form the gussets. The virtual images 108B of the reflection of the colored line 108A forming outwardly directed rays in three-dimensional form at the corners of the pattern in panel 92 in the reflective metallized surface of the panel 94 and triangular member 102.

Thus, it is apparent that there has been provided, in accordance with the invention, a display-type greeting card that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

The embodiments of the invention in which an exclusive property or privilege is claimed are defined as follows:

1. A display card comprising a pair of panels hingedly connected for movement between open and closed positions;

each panel has a surface, a reflective metallized sheet laminated to the surface of one of said panels;

a reflective indicia secured to the surface of the other of said panels, said indicia being in a face-to-face relationship with said reflective metallized surface when said panels are in the closed position; and gusset means connected to the edges of said panels for limiting the opening of said panels to a predetermined angular relationship wherein said indicia appear as a virtual image in the reflective surface of said one panel.

2. The card according to claim 1 wherein one of said gusset means is provided with a reflective surface on, wherein a virtual image of the pattern appears in the reflective surface of said gusset means.

3. The card according to claim 1 wherein said gusset means includes two identical triangular panels which fold inwardly on closing of said pair of panels.

4. The card according to claim 1 wherein said gusset means comprises two identical panels which fold outwardly when said pair of panels are closed.

5. A display card comprising a pair of panels hingedly interconnected at their vertical edges, each of said panels including a reflective surface;

a first indicia secured to the surface of one of said panels, a second indicia secured to the surface of the other of said panels, and gusset means interconnecting said panels, said gusset means holding said panels in an angular relationship wherein the virtual image of each of said indicia will appear in the other of said mirror-like surfaces to provide a three-dimensional figure in both of said panels.

6. The card according to claim 5 wherein said gusset means limits the angle between said panels when opened to an angle of 40° or less.

7. The card according to claim 5 wherein said first and second indicia comprise branches of a tree which are offset from each other to form a multiple reflective image of a three-dimensional image of a tree.

* * * * *